US006385995B1

(12) United States Patent
Komatsubara et al.

(10) Patent No.: US 6,385,995 B1
(45) Date of Patent: May 14, 2002

(54) APPARATUS HAVING A REFRIGERATION CIRCUIT

(75) Inventors: Takeo Komatsubara; Toshiyuki Ebara, both of Osaka-fu (JP)

(73) Assignee: Sanyo Electric Co. Ltd., Osaka-fu (JP)

( * ) Notice: Subject to any disclaimer, the term of this patent is extended or adjusted under 35 U.S.C. 154(b) by 0 days.

(21) Appl. No.: 09/609,341

(22) Filed: Jul. 5, 2000

(30) Foreign Application Priority Data

Jul. 6, 1999 (JP) ..... 11-191759

(51) Int. Cl.[7] ..... F25B 31/00
(52) U.S. Cl. ..... 62/505
(58) Field of Search ..... 62/498, 505, 501, 62/502, 503, 504; 417/366; 418/83

(56) References Cited

U.S. PATENT DOCUMENTS 5,417,872 A * 5/1995 Fukuda et al. ..... 508/284
5,548,973 A * 8/1996 Komine et al. ..... 62/469
5,553,465 A * 9/1996 Fukuda et al. ..... 62/468
5,579,651 A * 12/1996 Sugiyama et al. ..... 62/469
5,711,165 A * 1/1998 Iizuka et al. ..... 62/474
6,029,459 A * 2/2000 Iizuka et al. ..... 62/84
6,035,661 A * 3/2000 Sunaga et al. ..... 62/498
6,176,094 B1 * 1/2001 Ohta et al. ..... 62/114

* cited by examiner

*Primary Examiner*—Teresa Walberg
*Assistant Examiner*—Daniel Robinson
(74) *Attorney, Agent, or Firm*—Weingarten, Schurgin, Gagnebin & Lebovici LLP

(57) ABSTRACT

There is provided an apparatus where a first cooler and a second cooler are provided in a refrigeration circuit and difluoromethane having its temperature lowered by these devices is let into a rotary compressor and compressed therein. As a result, the apparatus with high performance and reliability is provided without impairment of the chemical stability of lubricant oil or difluoromethane if the difluoromethane is used as a refrigerant.

3 Claims, 2 Drawing Sheets

APPARATUS HAVING A REFRIGERATION CIRCUIT

BACKGROUND OF THE INVENTION

1. Field of the Invention

The present invention relates to an apparatus having a refrigeration circuit using difluoromethane as a refrigerant.

2. Detailed Description of the Related Art

Conventionally, chlorodifluoromethane (R22, boiling point: −40.8° C.) has been used as a refrigerant for an apparatus having a refrigeration circuit. R22 is however potentially highly destructive to ozone. R22 discharged into the atmosphere and reaching the ozone layer in the upper atmosphere destroys this ozone layer. Therefore, R22 has been under CFC restriction.

The destruction of the ozone layer is caused by chlorine (Cl) included in the refrigerant. Therefore, a refrigerant free from chlorine such as difluoromethane (referred to as HFC-32 or R32, boiling point: −52° C.) is considered as a substitute refrigerant for R22 for its relatively small global warming potential (GWP) and high efficiency (with COP increased by about 10%).

As a result, there has been a demand for development of an apparatus having a refrigeration circuit using difluoromethane. Above all, development of a highly reliable, high performance compressor adapted to the use of difluoromethane has been awaited.

Meanwhile, compressors are divided into reciprocating type and rotating type compressors. The reciprocating type compressor suffers from noise or vibration disadvantages. Therefore, there has been a demand for a rotating type compressor using difluoromethane.

However, when difluoromethane is compressed using the rotating type compressor, the temperature of the compressed difluoromethane could be higher than the temperature of other conventional refrigerants. As a result, the chemical stability of the lubricating oil or the difluoromethane itself is lowered, which disadvantageously lowers the performance and reliability of the apparatus having a refrigeration circuit as a whole.

SUMMARY OF THE INVENTION

The present invention is directed to a solution to this problem, and it is an object of the present invention to provide an apparatus having are frigeration circuit with high reliability and performance by which the chemical stability of the lubricating oil or difluoromethane used as a refrigerant is not impaired.

According to the present invention, there is provided an apparatus having a refrigeration circuit including a rotary compressor having a rotary roller, and a vane forming a compression space inside by abutting against the roller, the compressor storing in an enclosed container a rotary compressing element provided with a plurality of cylinders having both opening ends closed and compressing an inhaled refrigerant in a plurality of stages by the compressing element for discharging; a condenser; an expansion valve and a cooler, where difluoromethane is used as the refrigerant.

Here, the apparatus having a refrigeration circuit according to a first aspect of the invention includes a first cooler provided in a refrigerant flow path between the cylinders of the rotary compression element for cooling the difluoromethane to be compressed in the plurality of stages.

According to the first aspect of the present invention, the first cooler lowers the temperature of the difluoromethane as a refrigerant inhaled/discharged to/from the rotary compressor, so that the chemical stability of the lubricating oil or difluoromethane is not impaired and that the performance and reliability of the apparatus having a refrigeration circuit may be improved.

The apparatus having a refrigeration circuit according to a second aspect of the present invention has a second cooler provided in the refrigeration circuit for cooling difluoromethane.

According to the second aspect of the present invention, the second cooler lowers the temperature of the difluoromethane as a refrigerant inhaled/discharged to/from the rotary compressor, so that the chemical stability of the lubricating oil or difluoromethane is not impaired and that the performance and reliability of the apparatus having a refrigeration circuit may be improved.

The apparatus having a refrigeration circuit according to a third aspect of the present invention includes a first cooler provided in the refrigerant flow path between the cylinders of the rotary compression elements for cooling difluoromethane to be compressed in a plurality of stages, and a second cooler provided in the refrigeration circuit for cooling difluoromethane.

According to the third aspect of the invention, the first cooler and the second cooler further lower the temperature of difluoromethane as a refrigerant inhaled/discharged to/from the rotary compressor, so that the chemical stability of lubricating oil or the difluoromethane is not impaired and that the performance and reliability of the apparatus having a refrigeration circuit may be even more improved.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

One embodiment of the present invention will be now described in conjunction with the accompanying drawings.

Figure 1:
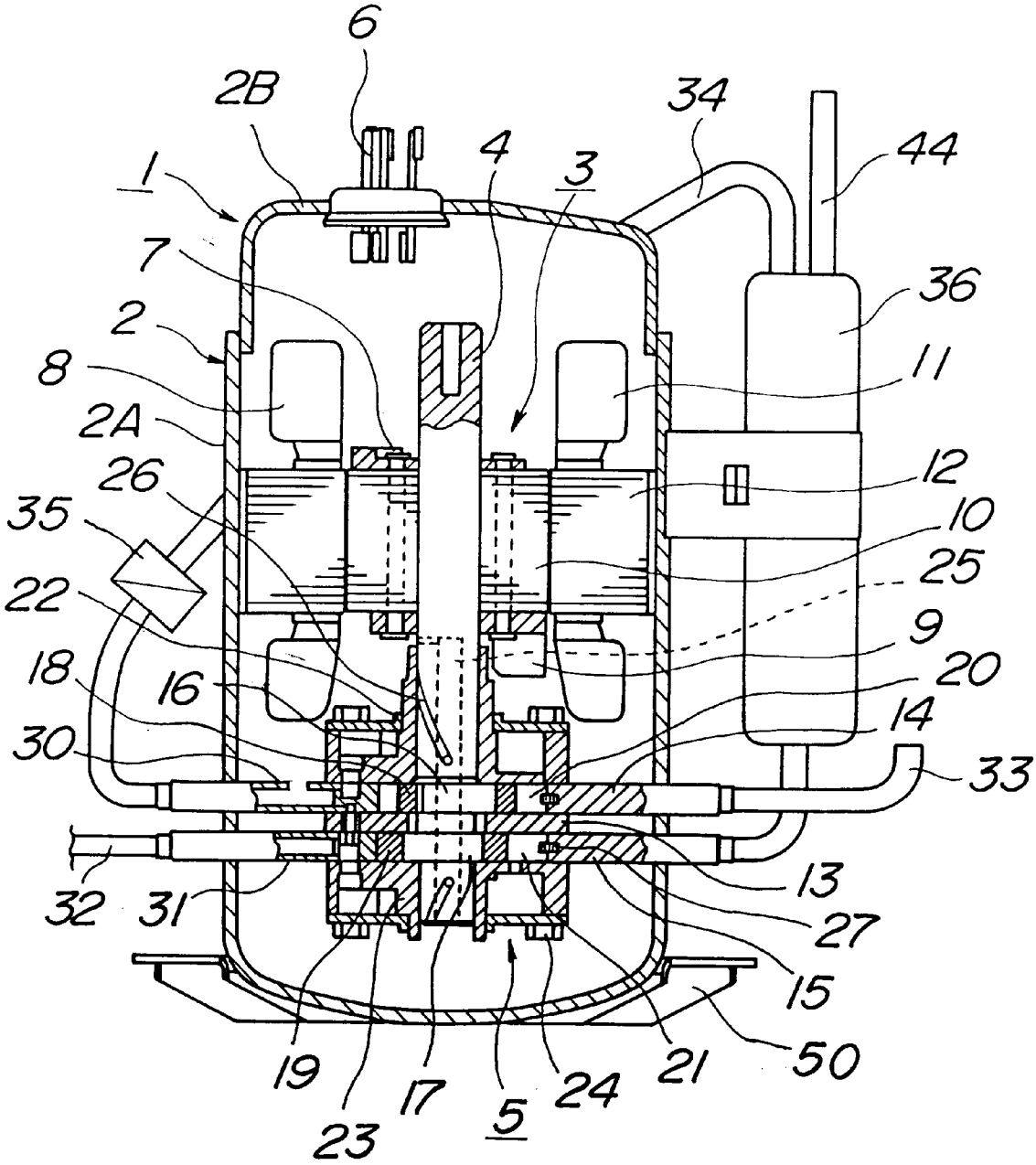
FIG. 1 is a longitudinal sectional view of a two-cylinder type, rotary compressor included in an apparatus having a refrigeration circuit according to one embodiment of the present invention.

FIG. 1 is a longitudinal sectional view of a rotary compressor included in an apparatus having a refrigeration circuit according to the present invention.

The two-cylinder type, rotating type compressor (rotary compressor) 1 includes an electric motor element 3 provided at the upper part in an enclosed container 2 made of a metal such as iron, and a rotary compressing element 5 provided under the electric motor element 3 and driven to rotate by a rotary shaft 4 of the electric motor element 3.

The lower part of the enclosed container 2 serves as a lubricating oil reservoir. The enclosed container 2 includes a container body 2A to store the electric motor element 3 and the rotary compressing element 5, and a sealing lid 2B to seal the container body 2A. The sealing lid 2B is provided with a terminal 6 (wiring thereto is omitted) to supply electric power to the electric motor element 3.

The electric motor element 3 includes a rotor 7 and a stator 8. The rotor 7 includes a permanent magnet which is not shown in a layered body 10 made of electromagnetic steel sheets layered on one another. The stator 8 includes a layered body 12 made of ring-shaped electromagnetic steel sheets layered on one another and a winding 11 attached therearound. Reference numeral 9 represents a balancer.

The structure is referred to as DC motor, but a motor referred to as AC motor including an aluminum core inserted within the layered electromagnetic steel sheets may be used.

If, for example, the apparatus is used for the air conditioning system of an automobile, the engine of the automobile may be used as a driving source or other driving sources may be used.

The rotary compressing element 5 includes an intermediate partition plate 13, upper and lower cylinders 14 and 15 attached above and under the intermediate partition plate 13, upper and lower rollers 18 and 19 rotated in the upper and lower cylinders 14 and 15 by the upper and lower eccentric portions 16 and 17 of the rotary shaft 4, upper and lower vanes 20 and 21 in contact with the upper and lower rollers 18 and 19 to separate the inside of the upper and lower cylinders 14 and 15 into a high pressure chamber and a low pressure chamber, a main frame 22 to block the upper and lower openings of the upper and lower cylinders 14 and 15 and allow the rotary shaft 4 to rotate, and a bearing plate 23.

In addition, these elements are provided in the order of the main frame 22, the upper cylinder 14, the intermediate partition plate 13, the lower cylinder 15, and the bearing plate 23, and are coupled by bolts 24.

The rotary shaft 4 is provided with a fill opening 25 to supply lubricating oil to each sliding portion of the rotary compressing element 5. Formed at the outer peripheral surface of the rotary shaft 4 is a fill groove 26 in communication with the fill opening 25 to guide lubricating oil to the inside of the upper and lower rollers 18 and 19. Furthermore, the upper and lower vanes 20 an 21 are provided with springs 27 to constantly urge the upper and lower rollers 18 and 19.

The lubricating oil used in the present invention may exist lubricating oil such as mineral oil, alkyl benzene oil, ether oil and ester oil.

The upper and lower cylinders 14 and 15 are respectively provided with upper and lower tubes (not shown) to introduce a refrigerant and upper and lower outlet tubes 30 and 31 to discharge the refrigerant. The upper and lower introduction tubes and the upper and lower outlet tubes 30 and 31 are connected with refrigerant pipes 32, 33 and 34.

Note that reference numeral 50 represents a pedestal to support the enclosed container 2. Reference numeral 36 represents a suction muffler.

Figure 2:
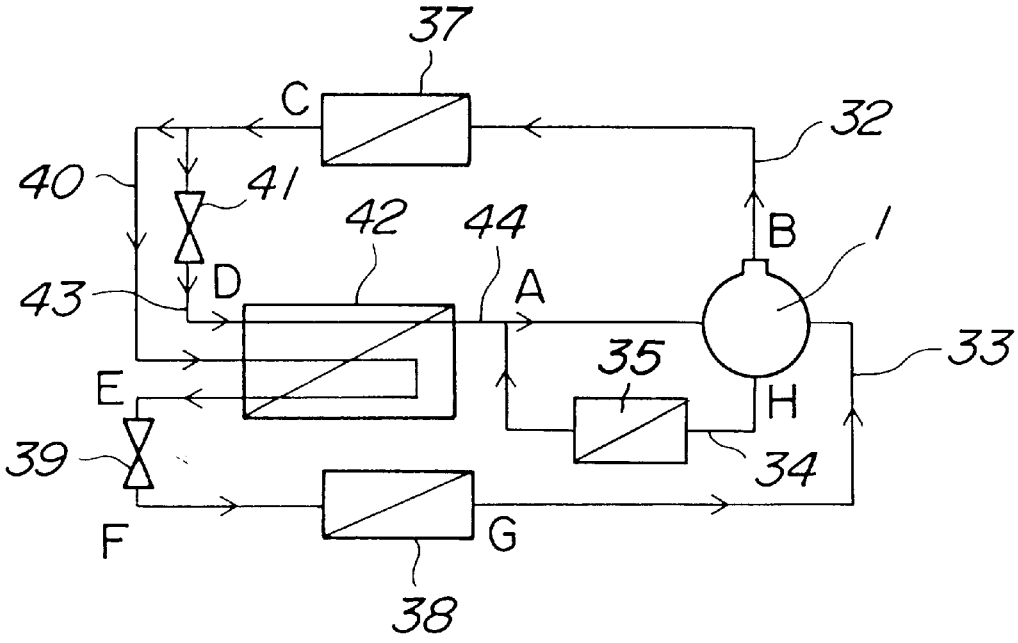
FIG. 2 is a circuit diagram of an apparatus having a refrigeration circuit according to the embodiment of the present invention.

The refrigerant circuit of the two-cylinder type, rotary compressor 1 described in detail in connection with FIG. 1 will be now described in conjunction with FIGS. 2 and 3. FIG. 2 shows a refrigeration circuit of the apparatus according to the present invention.

In this two-cylinder type, rotary compressor 1, the lower outlet tube 31 and a condenser 37 provided at the lower cylinder 15 of the rotary compressor 1 are connected through the refrigerant pipe 32 on the discharge side. The condenser 37 and a cooler 38 are connected by a refrigerant pipe 40 through an expansion valve 39. The cooler 38 and the upper introduction tube of the upper cylinder 14 of the rotary compressor 1 are connected by the refrigerant pipe 33 on the inlet side.

Furthermore, the refrigerant pipe 40 connecting the condenser 37 and the expansion valve 39 is provided with a bypass tube 43 connecting to a second cooler 42 through a by pass expansion valve 41.

The connecting refrigerant pipe 34 to connect the upper outlet tube 30 provided at the upper cylinder 14 of the rotary compressor 1 and the lower introduction tube (not shown) of the lower cylinder 15 is provided with a first cooler 35 before connection to a pipe 44. The pipe 44 from the second cooler 42 is coupled in the suction muffler 36.

Note that the second cooler 42 having a double pipe structure allows the refrigerant from the bypass tube 43 to flow in the inner part and the refrigerant from the refrigerant pipe 40 to flow in the outer part. The invention is not limited to this structure. Conversely, the inner part may be for the refrigerant pipe 40, while the outer side may be for the bypass tube 43. In addition, they may be in contact in a thermally conductive manner. For example, two pipes are jointed and processed to have a spiral jointed pipe structure.

The refrigerant pipe 40 after branching from the bypass tube 43 is introduced to the second cooler 42, in which the pipe 40 is provided in contact with the bypass tube 43 following the by pass expansion valve 41 in a thermally conductive manner. The pipe 40 is then connected to the expansion valve 39 described above.

As a result, a gas refrigerant of difluoromethane compressed by the two-cylinder type, rotary compressor 1 and attaining a high temperature is cooled by the condenser 37 and performs thermal exchange with the bypass tube 43 in the second cooler 42, in other words radiates heat, and then expands by the expansion valve 39. Then, the gas refrigerant of difluoromethane is let into the cooler 38, radiates heat therein and is then returned from the refrigerant pipe 33 on the inlet side to the rotary compressor 1.

The refrigerant condensed by the condenser 37 is partly branched to bypass tube 43, adiabatically expanded by the bypass expansion valve 41 and then absorbs heat from the refrigerant pipe 40 in the second cooler 42. There frigerant having absorbed heat in the second cooler 42 mixes with refrigerant at a high temperature and a high pressure by the upper cylinder 14 to cool the refrigerant at the high temperature and high pressure, and is also let into the lower cylinder 15. Note that there frigerant having absorbed heat by the second cooler 42 is at a lower temperature than the high temperature and high pressure refrigerant discharged from the upper cylinder 14.

Figure 3:
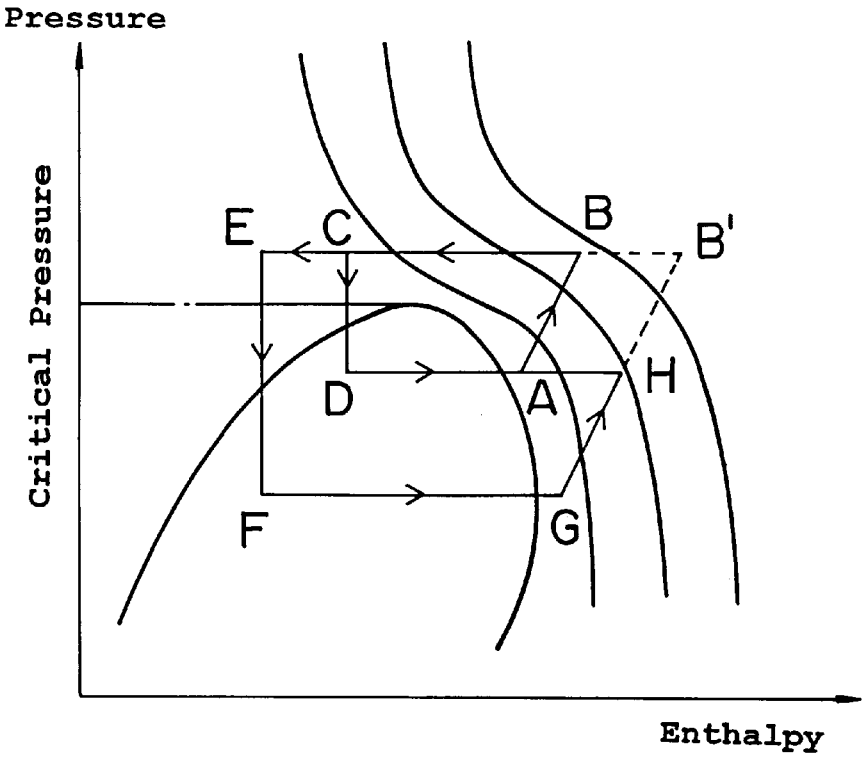
FIG. 3 is a Mollier diagram in the refrigeration circuit of the apparatus according to the embodiment of the present invention.

FIG. 3 is a Mollier diagram in connection with the refrigeration circuit of the apparatus according to the present invention.

In FIG. 3, the point A represents the confluence of the refrigerant discharged from the second cooler 42 and the refrigerant discharged from the upper cylinder 14 of the compressor 1, which is sucked into the lower cylinder 15. The point B represents the refrigerant discharged from the lower cylinder 15.

In the state at the point B, the temperature of the refrigerant is lower than that in the case of a single-cylinder type, rotary compressor at the same pressure.

More specifically, in the refrigeration circuit shown in FIG. 2, the temperature of the difluoromethane refrigerant (at the point B') which has been compressed to the same pressure as that at the point B by the single cylinder rotary compressor without the bypass tube 43, the bypass expansion valve 41 and the second cooler 42 and discharged is higher than the temperature of the difluoromethane refrigerant at the point B as shown by the broken line in FIG. 2.

The point C represents a refrigerant condensed at the condenser 37 and then branched. The refrigerant is adiabatically expanded at the bypass expansion valve 41. The point D represents the refrigerant adiabatically expanded to have its pressure lowered and its heat radiated. The refrigerant then comes into the second cooler 42 to cool the refrigerant at the point C to the state at the point E.

The overcooled refrigerant at the point E is adiabatically expanded at the expansion valve 39, and attains the state at the point F. Then, as denoted by the point G, the refrigerant having its temperature raised to a high level by heat absorbed at the cooler 38 comes into the upper cylinder 14.

As denoted by the point H, the refrigerant compressed by the upper cylinder 14 and having its temperature and pressure raised has a lowered pressure at the second cooler 42 as described above, is used for super cooling, and joins the temperature-raised refrigerant (though at a lower temperature than the high-temperature, high-pressure refrigerant discharged from the upper cylinder 14 as described above). The resultant temperature-lowered refrigerant comes into the rotary compressor 1 as denoted by the point A.

As in the forgoing, compression is performed in a plurality of stages, and therefore the temperature of the gas discharged from the rotary compressor 1 may be restrained at a low level. As a result, difluoromethane can be compressed by the rotary compressor 1 without providing a special mechanism therefor, and the difluoromethane itself or even conventional lubricating oil will not lose its chemical stability.

In addition, the apparatus having a refrigeration circuit described above may be subject to various modifications without changing the essential part. Other embodiments may include air conditioners for home use, air conditioners for business use (packaged air conditioners), air conditioners for automobile, refrigerators for home use, refrigerators for business use, freezers for business use, refrigerator-freezers for business use, showcases, vending machines and the like.

What claimed is:

1. A refrigeration apparatus wherein difluoromethane is circulated as refrigerant in a refrigeration circuit in which a single compressor having a two-rotary cylinder, a condenser, an expansion valve and a heat exchanger are connected in an annular arrangement with refrigerant pipes, comprising:

two cylinders of said two-rotary cylinder are connected in series between said condenser and said heat exchanger and compress said refrigerant individually, and said apparatus further comprises a first cooler for cooling the refrigerant flowing from said cylinder connecting said heat exchanger of said compressor and the refrigerant having been cooled by said first cooler is supplied to another cylinder thereof.

2. A refrigeration apparatus according to claim 1, characterized in that:

said apparatus further comprises a second cooler for cooling the refrigerant flowing out of said condenser and a refrigerant flow being heated by said refrigerant in said second cooler, and the refrigerant having been cooled by said second cooler is supplied to said expansion valve, and then said refrigerant flow connects to connection pipe of two cylinders of said two-rotary cylinder.

3. A refrigeration apparatus wherein difluoromethane is circulated as refrigerant in a refrigeration circuit in which a single compressor having a two-rotary cylinder, a condenser, an expansion valve and a heat exchanger are connected in an annular arrangement with refrigerant pipes, comprising:

two cylinders of said two-rotary cylinder are connected in series between said condenser and said heat exchanger and compress said refrigerant individually, and said apparatus further comprises a second cooler for cooling the refrigerant flowing out of said condenser and a refrigerant flow being heated by said refrigerant in said second cooler, and the refrigerant cooled by said second cooler is supplied to said expansion valve, and then said refrigerant flow connects to connection pipe of two cylinders of said two-rotary cylinder.

* * * * *

UNITED STATES PATENT AND TRADEMARK OFFICE

CERTIFICATE OF CORRECTION

PATENT NO. : 6,385,995 B1
DATED : May 14, 2002
INVENTOR(S) : Takeo Komatsubara et al.

It is certified that error appears in the above-identified patent and that said Letters Patent is hereby corrected as shown below:

Column 1,
Line 45, “are frigeration” should read -- a refrigeration --;

Column 3,
Line 39, “20 an 21” should read -- 20 and 21 --;

Column 4,
Line 6, “by pass” should read -- bypass --;
Line 25, “by pass” should read -- bypass --;
Line 40, “There frigerant” should read -- The refrigerant --;
Line 45, “there frigerant” should read -- the refrigerant --; and Column 6,
Line 1, “What claimed is:” should read -- What is claimed is: --.

Signed and Sealed this

Twenty-fifth Day of February, 2003

JAMES E. ROGAN
*Director of the United States Patent and Trademark Office*